US005755156A

United States Patent [19]

Stein et al.

[11] Patent Number: 5,755,156

[45] Date of Patent: May 26, 1998

[54] CALENDAR INCLUDING A ROLLER WITH A DUCTILITY FACTOR F GREATER THAN OR EQUAL TO 4

[75] Inventors: Heinrich Stein, Mönchengladbach; Dieter Junk, Kreuztal, both of Germany

[73] Assignee: Voith Sulzer Finishing GmbH, Krefeld, Germany

[21] Appl. No.: 850,283

[22] Filed: May 5, 1997

Related U.S. Application Data

[63] Continuation of Ser. No. 655,453, May 30, 1996, abandoned.

[30] Foreign Application Priority Data

Jun. 13, 1995 [DE] Germany ..... 195 21 402.1

[51] Int. Cl.[6] ..... D21G 1/00; B30B 3/04

[52] U.S. Cl. ..... 100/331; 100/162 B; 100/172; 492/7; 492/50; 492/54; 492/56

[58] Field of Search ..... 100/38, 92, 93 R, 100/93 RP, 161–167, 172, 331, 103; 492/7, 20, 46, 50, 54, 56, 58, 59

[56] References Cited

U.S. PATENT DOCUMENTS

| | | | |
|---|---|---|---|
| 3,131,625 | 5/1964 | Küsters et al. . | |
| 3,871,808 | 3/1975 | Ancker . | |
| 5,029,521 | 7/1991 | Pav et al. | 100/162 B |
| 5,240,666 | 8/1993 | Schnyder et al. . | |
| 5,334,125 | 8/1994 | Vähäpesola | 492/58 |
| 5,438,920 | 8/1995 | Koivukunnas et al. | 100/331 |

FOREIGN PATENT DOCUMENTS

| | | |
|---|---|---|
| 32 01 635 | 2/1984 | Germany . |
| 41 26 232 | 11/1992 | Germany . |
| 93 14 568.3 | 3/1995 | Germany . |
| 95/14813 | 6/1995 | WIPO . |

OTHER PUBLICATIONS

Letter from Küsters Company to Haindl GmbH dated Oct. 21, 1994.

"Die neuen Superkalanderkonzepte", Voith Sulzer Papiertechnik, 1994, No. 05/94 d.

*Primary Examiner*—Stephen F. Gerrity
*Attorney, Agent, or Firm*—Darby & Darby

[57] ABSTRACT

A calender includes at least one roller stack. The upper roller and lower roller of the roller stacks are deflection compensation rollers. The upper roller and/or the lower roller have an outer covering made of a flexible plastic and is designed to bend easily. The roller adjacent to the upper and lower roller is a hard roller.

13 Claims, 2 Drawing Sheets

CALENDAR INCLUDING A ROLLER WITH A DUCTILITY FACTOR F GREATER THAN OR EQUAL TO 4

This is a continuation of application Ser. No. 08/655,453, filed May 30, 1996 (now abandoned).

BACKGROUND OF THE INVENTION

1. Field of the Invention

The present invention relates to a calender having at least one roller stack. The upper and lower rollers are deflection compensation rollers. Each roller has a roller sleeve that is supported by hydrostatic support elements. The support elements are disposed on a fixed carrier within the sleeve. The central rollers of the roller stack (i.e., those roller disposed between the upper roller and the lower roller) include both hard rollers and soft rollers. The rollers form at least four working nips, which are formed by the juncture of one hard roller and one soft roller. The roller stack may include one changeover nip which is formed by the juncture of two soft rollers.

2. Discussion of the Related Art

Calenders, such as the one described above, are known, for example, from the 1994 brochure "The New Supercalender Designs" from the firm of Sulzer Papertec. Calenders finally treat a web of paper so that the paper will have the desired values of smoothness, gloss, thickness, bulk, etc. The "soft" rollers have a covering that is made primarily of a fibrous material. Deformation energy is applied to the web of paper to increase the effect of the treating of the paper. If a portion of the deformation energy is to be applied in the form of heat, the heating is carried out through the hard rollers. The upper roller and lower roller are considered to be hard rollers because their roller sleeves are made of chilled cast iron.

Generally, the third roller from the bottom of the roller stack is rotatably driven. This roller then drives the remaining rollers.

It is an object of the present invention to provide a calender of the type described above, but which provides better uniformity in the desired paper parameters.

SUMMARY OF THE INVENTION

In accordance with the present invention, the object is achieved by providing the roller sleeve of the upper and/or lower roller with a covering made entirely, or at least substantially, of a flexible plastic. The roller disposed adjacent to the upper and/or lower roller is a hard roller. The roller sleeve is designed so that it can bend relatively easily. Thus, the sleeve must have a ductility factor:

$$F=\left(\frac{1.4\cdot 10^5}{E}\right)\cdot\left(\frac{100}{S}\right)^{2.65}\geqq 4$$

where

E=Modulus of elasticity of the roller sleeve in $N/mm^2$; and

S=Wall thickness of the roller sleeve in mm.

The ductility factor F is preferably greater than 5. In fact, the ductility factor can be between 6 and 10.

The roller sleeve according to the present invention can be deformed much more easily than a conventional chilled iron sleeve. This increased flexibility of the roller sleeve can be achieved by using a lower modulus of elasticity and/or by using a smaller wall thickness. Because of the roller sleeve, the upper and/or lower roller acts as a soft roller. Thus, the uppermost or lowest central roller can be a hard roller. An improved uniformity in the desired parameters is achieved because the forces exerted by the support elements act on the paper to a substantially greater extent and the effect of the forces is not reduced by the stiffness of the roller sleeve. In addition, because the adjacent hard roller completely absorbs the local line load changes of the deflection compensation roller, the effects of the deflection compensation roller on the paper are even stronger.

The effective weight of the deflection compensation roller is substantially reduced because of its smaller wall thickness, which, of course, implies a cost savings. The smaller wall thickness results in a smaller outside diameter, which creates a higher compressive stress in the roller nip at a given line load. The minimum line load with which the calender can be operated is also reduced by using an upper roller according to the present invention. The flexible plastic helps dampen shocks in the roller stack, thereby increasing the smoothness at which the calender operates.

The roller sleeve is formed by an inner carrier made of a material having a predetermined resistance to wear. The outer covering, which is made of the flexible plastic material, has a higher resistance to wear than the resistance to wear of the inner carrier material. This is especially true if the inner carrier is made of lamellar graphite cast iron, that is, a cast iron with lamelliform graphite. This material has a modulus of elasticity that is approximately 25 percent less than that of chilled cast iron. Therefore, the wall thickness can be reduced by almost 50 percent when compared to the wall thickness of a chilled cast iron roller sleeve. With this material, ductility factors F of between 6 and 8 can be attained. Still, this gray cast iron has very little resistance to wear. This disadvantage is compensated for by the fact that the outer covering is made of flexible plastic, which also serves as a protective coating against wear. The outer covering has a coating thickness of between 8 and 15 mm, and preferably, about 10 mm.

The inner carrier can also be made of nodular cast iron, i.e., a cast iron made with spherical graphite. This material permits a wall thickness reduction of up to 59 percent as compared to chilled cast iron. Additionally, a ductility factor of more than 8 can be obtained.

The flexible plastic is preferably a fiber-reinforced epoxy resin. The fibers are preferably made of glass or carbon so that the desired flexibility is achieved while also maintaining the necessary resistance to wear. For example, the outer covering can be made from a material sold under the brand name "TopTec 4" from the firm of Scapa-Kern, of Wimpassing, Austria.

The deflection compensation roller can be controlled in multiple zones. In other words, hydraulic fluid can be directed, at varying (i.e., predetermined independent) pressures to the support elements, either individually or in pairs. Conventionally, such individual or pair control of the support elements would have a minimal, if any, effect when using a chilled iron roller sleeve. It is now possible to influence the parameters of the paper over very narrow regions, even in the uppermost working nip, which results in a higher cross-wise (i.e., axial) uniformity in the desired parameters in the web of paper.

The uppermost central roller is preferably heated. Hence, deformation energy, in the form of heat, is supplied to the web of paper in the first working nip. Therefore, the upper roller does not have to be provided with a heating device, which would be necessary in a conventional calender to heat the web in the first working nip. Thus, the upper roller is simpler to make and is, therefore less expensive. Additionally, the upper roller can be more severely deformed with a reduced risk of damage to any internal seals because the upper roller is exposed to lower temperatures.

In a preferred embodiment, all of the hard central rollers are heatable. Because the uppermost and lowest central rollers are designed as hard rollers, the number of hard heatable central rollers is increased by one as compared to a conventional roller stack having the same total number of rollers. By having one more hard heatable roller, more thermal energy, or the same thermal energy at a lower temperature level, can be transmitted to the paper in a relatively simple manner.

The heating of the hard rollers can be achieved by using steam, which can be supplied at a high pressure. Steam heating is considerably simpler and less expensive than heating a hard roller with oil, which is conventionally necessary to heat deflection compensation rollers.

In an embodiment according to the present invention having a twelve-roller stack, the fourth roller from the bottom is preferably rotatably driven. In other words, the driving means is shifted from the third to the fourth roller, which results in an improved distribution of power. Thus, there is less unintentional sideways movement of the driving roller and the adjacent central rollers. Because there is less sideways movement, the overall dimensions of the rollers can be reduced, which, with the same line load, results in a higher compressive stress in the roller nips and, thus, better results in the treatment of the paper.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PREFERRED EMBODIMENT

Figure 1:
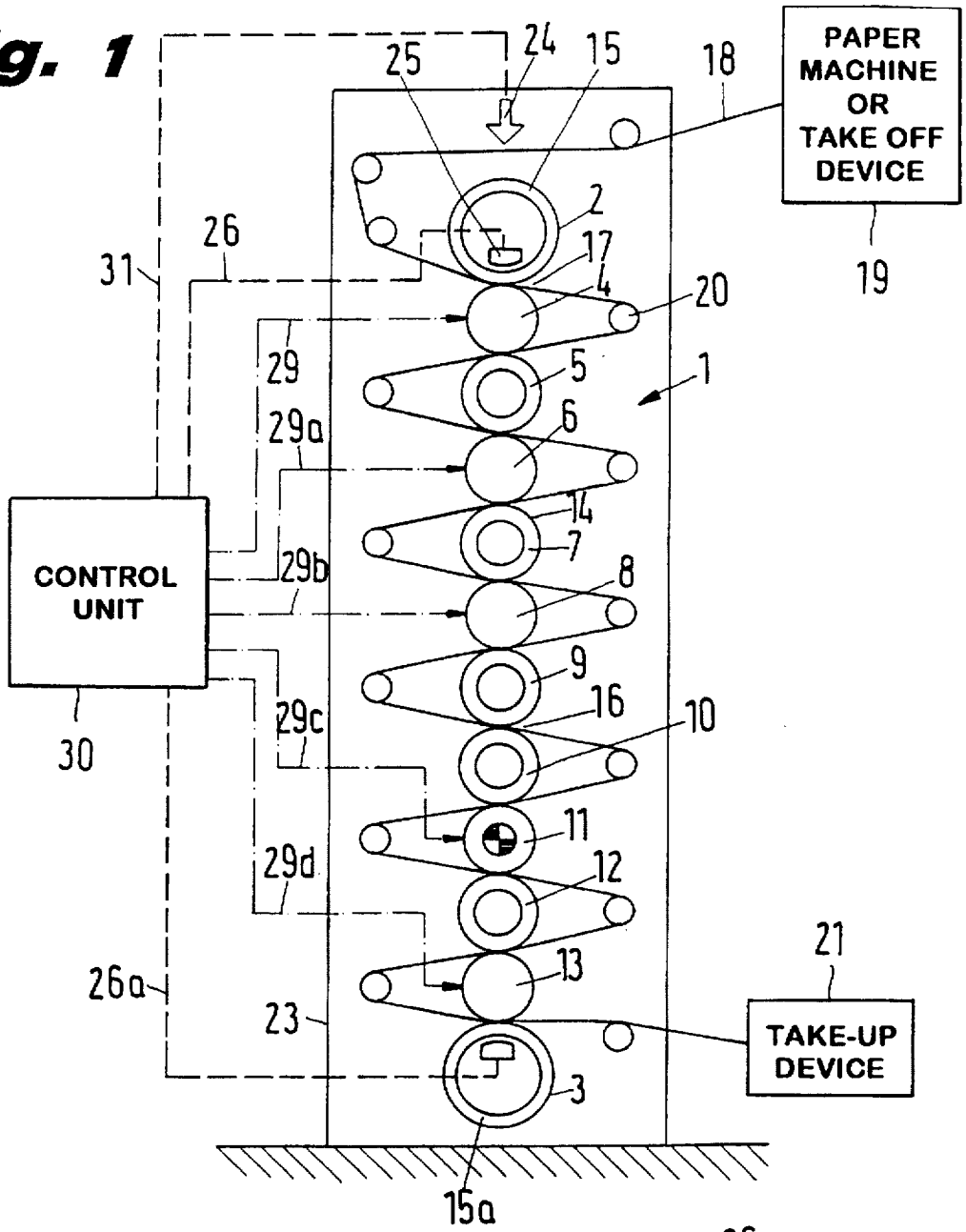
FIG. 1 is a schematic illustration of a calender in accordance with the present invention.

Referring now to FIG. 1, a roller stack 1 is illustrated. Roller stack 1 has twelve rollers, including an upper roller 2 and a lower roller 3. Both upper roller 2 and lower roller 3 are configured as deflection compensation rollers. Ten central rollers are disposed between upper roller 2 and lower roller 3. In order from top to bottom, as illustrated in FIG. 1, the central rollers include a heatable hard roller 4, a soft roller 5, a heatable hard roller 6, a soft roller 7, a heatable hard roller 8, two soft rollers 9 and 10, a rotatably driven, heatable hard roller 11, a soft roller 12 and a heatable hard roller 13. A working nip 17 is formed by the juncture of a hard roller and a soft roller. A changeover nip 16 is formed by the juncture of soft rollers 9 and 10.

Figure 2:
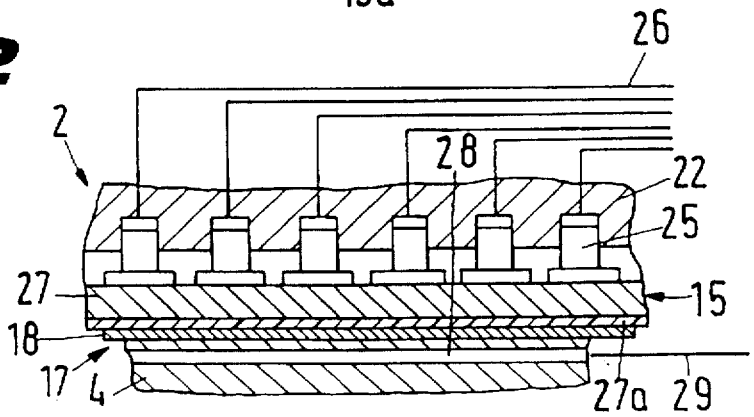
FIG. 2 is a partial cross-sectional view through the uppermost roller nip.

Each of the soft rollers 5, 7, 9, 10 and 12 has a covering 14 made of a flexible plastic material. Also, upper roller 2 has an outer roller sleeve 15 and lower roller 3 has an outer roller sleeve 15*a*. Roller sleeves 15, 15*a* preferably have an outer covering 27*a* that is made completely of a flexible plastic material as is illustrated in FIG. 2. Because the roller sleeves have a flexible outer covering, the upper roller 2 and the lower roller 3 act as soft rollers.

A web of paper 18 is fed into the calender either directly from a paper machine or from a take-off device 19. Web 18 first runs through six working nips 17 under the direction of guide rollers 20, then through the changeover nip 16, and finally, through four additional working nips 17. Thereafter, the web 18 is wound onto a take-up device 21. One side of the web of paper 18 contacts the soft rollers in the six upper working nips. Because of the transfer through the changeover nip 16, the other side of the web of paper 18 contacts the soft rollers in the four lower working nips. Thus, the desired surface structure, such as, for example, gloss or smoothness, is obtained on both sides of the web of paper 18.

FIG. 2 shows one possible embodiment of the rollers in the region of the uppermost working nip 17. The upper roller 2 includes an inner carrier 22 which is fixedly held in a housing 23 of the calender. Fixed carrier 22 can be loaded by a force 24. Roller sleeve 15 of the upper roller 2 is rotatably supported on fixed carrier 22 by means of closely spaced apart adjacent hydrostatic support elements 25. Each support element 25 is supplied with pressure by means of an individual control conduit 26. Roller sleeve 15 is formed by an inner carrier 27 and an outer covering 27*a*. Inner carrier 27 is in the shape of a pipe and is preferably made of lamellar graphite cast iron. Outer covering 27*a* is preferably made of a flexible plastic which has a greater resistance to wear than cast iron does. The plastic is preferably a material that can withstand an average compressive stress of more than 45 $N/mm^2$, and more preferably up to 60 $N/mm^2$. Additionally, a material that is relatively insensitive to marking is preferred. For example, the material can be a fiber reinforced (preferably carbon) epoxy resin, such as the TopTec 4 covering material referred to above. Inner carrier 27 has a substantially smaller wall thickness than a chilled cast iron sleeve that has the same inside diameter. For example, if a chilled cast iron sleeves has a thickness of from 80 to 145 mm, the lamellar or nodular graphite cast iron sleeves only has a thickness of 45 to 70 mm and plastic covering 27*a* has a wall thickness in the range of 8 to 15 mm, preferably 10 mm. Channels 28 are disposed in the hard roller 4. Channels 28 extend near the surface of the roller. Superheated steam can be supplied to channels 28 with increased pressure by means of control conduits 29, 29*a*, 29*b*, 29*c* and 29*d*. The superheated steam can be at, for example, a temperature of 220° C., which corresponds to a pressure of 22 bar and to a roller surface temperature of approximately 150° C.

The calender has a control unit 30 to regulate various functions of the calender. For example, the amount of downward force 24 applied to the upper roller 2, or more specifically, its fixed carrier 22, is controlled over control line 31. Because force is applied to upper roller 2, lower roller 3 is held in a fixed position. But the loading can also be carried out in the reverse direction. In other words, force 24 could act upwardly on the lower roller 3, and the upper roller 2 would then be held in a fixed position. The compressive stress that prevails in each of the individual working nips 17 can be determined based on the amount of loading. The compressive stress increases from the top working nip to the bottom working nip because the weight of each of the individual rollers disposed above the respective working nip is added to the loading force 24. But the increase in force is less according to the present invention than with known supercalenders having twelve rollers because of the relatively low weight of sleeve 15 of upper roller 2.

The pressure of the hydraulic fluid applied to the support elements 25 to adjust the deflection of the upper roller 2 and the lower roller 3 is controlled over control lines 26, 26*a*, respectively. Changes in the pressure applied to a support element 25 causes a corresponding deformation in the roller sleeve 15. Because the roller sleeve 15 of the present invention has greater flexibility, when cooperating with the hard roller 4, a correspondingly strong and more uniform treating action results in the web of paper that passes between these two rollers. The web of paper 18 experiences a strong treating effect even after passing through just the first working nip 17. Hence, a greater degree of uniformity in the desired parameters, such as gloss or smoothness, can be achieved.

The heating of the hard rollers 4, 6, 8, 11 and 13 can be controlled by means of control conduits 29, 29*a*, 29*b*, 29*c* and 29*d*, respectively. Thus, the web of paper 18 is brought to a higher temperature level in the first working nip 17. In this way, the effect of the pressure-loaded support elements 25 on the web of paper 18 is increased even further.

Figure 3:
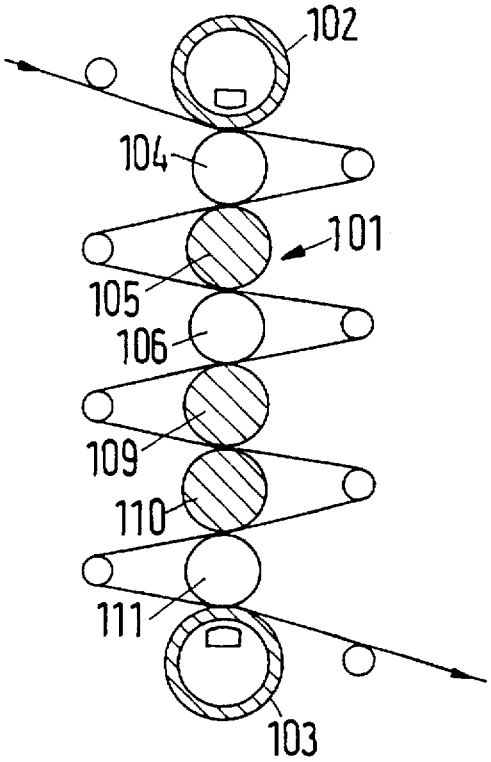
FIG. 3 is a schematic view of a modified calender having eight rollers.

Referring now to FIG. 3, a calender having a roller stack 101 is illustrated. Roller stack 101 has eight rollers. The soft flexible rollers are represented by hatching. The roller stack 101, therefore, includes an upper roller 102 and a lower roller 103. Additionally, a heatable hard roller 104, a soft roller 105, a heatable hard roller 106, two soft rollers 109 and 110, and a heatable hard roller 111 are disposed between upper roller 102 and lower roller 103.

Figure 4:
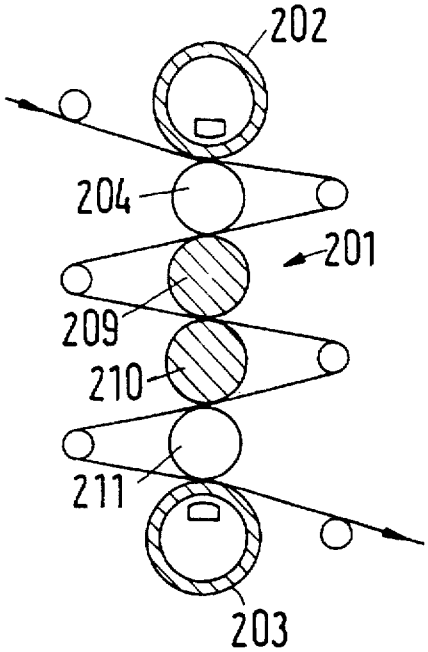
FIG. 4 is schematic view of a modified calender having six rollers.

FIG. 4 shows a calender with a roller stack 201 having six rollers, namely, an upper roller 202 and a lower roller 203, with a heatable hard roller 204, two soft rollers 209 and 210 and a heatable hard roller 211 disposed between the upper and lower roller.

In many cases, a smaller number of rollers in the stack is sufficient to manufacture a paper that is produced with high surface quality on both sides. This holds true particularly if, at least in the lowest working nip, a compressive stress above 42 N/mm$^2$, preferably between 45 and 60 N/mm$^2$, is applied, and a roller surface temperature over 100° C., preferably between 130° and 160° C., is maintained on the surface of the heated roller.

Figure 5:
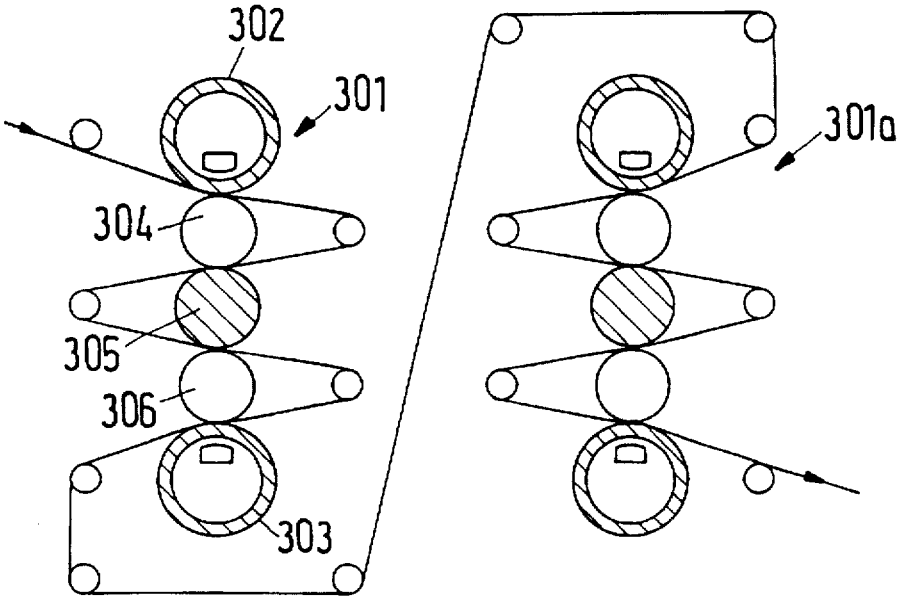
FIG. 5 is a schematic view of a modified calender with two stacks, each having five rollers.

FIG. 5 shows a calender with two roller stacks 301 and 301*a*, each stack having five rollers. Stack 301 has an upper roller 302 and a lower roller 303. A heatable hard roller 304, a soft roller 305 and a heatable hard roller 306 are disposed between upper roller 302 and lower roller 303. Stack 301*a* has an identical roller structure. However, the web of paper is directed in such a way that in the first stack one side of the web lies against the soft rollers and in the second stack the other side lies against the soft rollers. Thus, the web is treated such that is has a satin finish on both sides.

The roller stack 1 of the twelve-roller calender in FIG. 1 has five heatable hard rollers 4, 6, 8, 11 and 13. But known twelve-roller calenders have only four heated rollers. As a result, it is possible to supply 25 percent more thermal energy to the paper web and thereby increase the available deformation energy accordingly. Similarly, the calenders of FIGS. 3 and 4 also use one additional heatable roller as compared to conventional eight and six roller stacks, respectively. Additionally, the two-stack calender of FIG. 5 can use two additional heatable rollers as compared to a conventional two-stack calender, with each stack having five rollers.

The ductility of the sleeve of the upper roller 2 and possibly the lower roller 3 provides a ductility factor that is at least four times greater than a chilled cast iron sleeve, but preferably the ductility factor is more than five times greater. The preferred ductility can be achieved, for example, with a lamellar or nodular graphite sleeve that has a plastic covering, which has a low modulus of elasticity. Sleeves 15 could also be made entirely of plastic, which has a modulus of elasticity that is less than half that of chilled cast iron.

While all of the forms of implementation in the drawings show an even number of rollers in the stack, stacks with an odd number of rollers can also be used if the lower roller is provided with a hard roller sleeve. Of course, the illustrated calenders can be provided with additional known devices for improving the treatment of paper; for example, the central rollers can be supported on levers by means of which the effect of overhanging weights can be compensated for with the aid of compensating devices.

Having described the presently preferred exemplary embodiment of calender in accordance with the present invention, it is believed that other modifications, variations and changes will be suggested to those skilled in the art in view of the teachings set forth herein. It is, therefore, to be understood that all such modifications, variations, and changes are believed to fall within the scope of the present invention as defined by the appended claims.

We claim:

1. A calender comprising:

at least one roller stack having an upper roller and a lower roller, each of said upper roller and said lower roller being a deflection compensation roller and including an inner fixed carrier and an outer rotatable roller sleeve, said roller sleeve being supported on said inner fixed carrier by a plurality of hydrostatic support elements, said roller stack having a plurality of hard rollers and at least one soft roller disposed between said upper roller and said lower roller, said rollers forming at least four working nips, said roller sleeve of one of said upper roller and said lower roller having an inner carrier and an outer covering surrounding said inner carrier, said outer covering is substantially made of a flexible plastic, said roller sleeve of said one of said upper roller and said lower roller having a ductility factor F; where:

$$F=\left(\frac{1.4\cdot 10^5}{E}\right)\cdot\left(\frac{100}{S}\right)^{2.65}\geqq 4$$

where

E=Modulus of elasticity of the roller sleeve in N/mm$^2$

S=Wall thickness of the roller sleeve in mm, a roller disposed adjacent to said one of said upper roller and said lower roller being a hard roller, said inner carrier of said roller sleeve being comprised of a cast iron having a lower modulus of elasticity than chilled cast iron and having a relatively low resistance to wear.

2. The calender according to claim 1, wherein said ductility factor is greater than 5.

3. The calender according to claim 1, wherein said outer covering has a higher resistance to wear than the resistance to wear of said cast iron of said inner carrier.

4. The calender according to claim 3, wherein said inner carrier is made of lamellar graphite cast iron.

5. The calender according to claim 3, wherein said inner carrier is made of nodular cast iron and said outer covering of said roller sleeve is made of flexible plastic.

6. The calender according to claim 5, wherein said flexible plastic is a fiber-reinforced epoxy resin.

7. The calender according to claim 1, wherein said deflection compensation is controlled in a plurality of zones, a hydraulic fluid being individually directed to said plurality of hydrostatic support elements at predetermined independent pressures.

8. The calender according to claim 1, wherein said deflection compensation is controlled in a plurality of zones, a hydraulic fluid being directed to a pair of said plurality of hydrostatic support elements at a predetermined independent pressure.

9. The calender according to claim 1, wherein the roller disposed adjacent to said upper roller has means for heating a surface of said roller.

10. The calender according to claim 9, wherein said heating is effected by steam.

11. The calender according to claim 1, wherein all of said hard rollers disposed between said upper roller and said lower roller have means for heating a surface of said respective roller.

12. The calender according to claim 11, wherein said heating is effected by steam.

13. The calender according to claim 1, wherein said roller stack comprises twelve rollers, a fourth roller from a bottom of said roller stack being rotatably driven.

* * * * *